United States Patent [19]

DeVries et al.

[11] 4,411,804

[45] * Oct. 25, 1983

[54] SOLID PARTICLES CONTAINING LUBRICATING OIL COMPOSITION

[75] Inventors: Donald L. DeVries, South Holland; James M. DeJovine, Homewood, both of Ill.

[73] Assignee: Atlantic Richfield Company, Philadelphia, Pa.

[ * ] Notice: The portion of the term of this patent subsequent to Jun. 13, 1995, has been disclaimed.

[21] Appl. No.: 913,183

[22] Filed: Jun. 6, 1978

Related U.S. Application Data

[63] Continuation-in-part of Ser. No. 752,225, Dec. 20, 1976, Pat. No. 4,094,799, Ser. No. 893,098, Apr. 3, 1978, Pat. No. 4,134,844, Ser. No. 893,100, Apr. 3, 1978, Pat. No. 4,132,656, and Ser. No. 893,101, Apr. 3, 1978, Pat. No. 4,136,040.

[51] Int. Cl.[3] ..... C10M 1/12

[52] U.S. Cl. ..... 252/29; 252/25; 252/30; 252/50; 252/51.5 A; 252/401; 252/403

[58] Field of Search ..... 252/25, 29, 30, 50, 252/51.5 A, 401, 403

[56] References Cited

U.S. PATENT DOCUMENTS

| | | | |
|---|---|---|---|
| 3,278,429 | 10/1966 | Agnew et al. | 252/29 |
| 3,506,574 | 4/1970 | Stambaugh et al. | 252/51.5 A |
| 3,842,009 | 10/1974 | Barry et al. | 252/51.5 A |
| 3,931,020 | 1/1976 | Burgess et al. | 252/25 |
| 3,935,114 | 1/1976 | Donaho | 252/25 |
| 4,068,056 | 1/1978 | Engel et al. | 252/51.5 A |
| 4,094,799 | 6/1978 | DeVries et al. | 252/51.5 A |

*Primary Examiner*—Andrew Metz

*Attorney, Agent, or Firm*—John B. Goodman

[57] ABSTRACT

An improved lubricating oil composition comprising a major amount by weight of oil of lubricating viscosity, a minor amount by weight of solid particles effective to improve the lubricating properties of the composition; and a minor amount of certain dispersant —VI improver materials. This composition provides improved inhibition of sludge and varnish formation in use.

3 Claims, No Drawings

SOLID PARTICLES CONTAINING LUBRICATING OIL COMPOSITION

CROSS REFERENCE TO RELATED APPLICATION

This application is a continuation-in-part application of co-pending applications Ser. No. 752,225, filed Dec. 20, 1976 now U.S. Pat. No. 4,094,799; Ser. No. 893,098, filed Apr. 3, 1978 now U.S. Pat. No. 4,134,844; Ser. No. 893,100 filed Apr. 3, 1978 now U.S. Pat. No. 4,132,656; and Ser. No. 893,101 filed Apr. 3, 1978 now U.S. Pat. No. 4,136,040; the teachings of which are incorporated by reference herein.

BACKGROUND OF THE INVENTION

This invention relates to improved lubricating oil compositions. More particularly, this invention relates to lubricating oil compositions which include solid materials to enhance the properties of such compositions.

Oil compositions are conventionally used to lubricate internal combustion engines, for example, such engines which power motor vehicles. Previous studies have indicated that the inclusion of certain solid materials, e.g., graphite, in these oil compositions improves the engine's fuel efficiency. For example, studies reported in "Stable Colloid Additives for Engine Oils-Potential Improvement in Fuel Economy", James E. Bennington et al, Society of Automotive Engineers, Fuels and Lubricants Meeting, Houston, Texas, June 3-5, 1975, indicate that a gasoline mileage improvement of between 3 to 5 percent is obtained by adding one percent graphite to a conventional lubricating oil composition. Such improvement in fuel economy is particularly valuable in view of, for example, the short supply of such fuels.

However, other criteria must be met by lubricating oil compositions in order to be effective in modern internal combustion engines. For example, such compositions are required to meet certain specifications with regard to tendency to form deposits, e.g., varnish, sludge and the like, on engine components. The presence of the solid lubricants in these compositions tends to increase these deposit forming tendencies. A lubricating oil composition containing at least one of certain solid lubricants and having acceptable deposit forming characteristics is clearly desirable.

Therefore, one object of the present invention is to provide an improved lubricating oil composition.

Another object of this invention is to provide a solid particles-containing lubricating oil composition having reduced deposit forming tendency.

A still further object of the invention is to provide an improved method of lubricating an internal combustion engine. Other objects and advantages of the present invention will become apparent hereinafter.

SUMMARY OF THE INVENTION

An improved lubricating oil composition has now been developed. This composition comprises a major amount by weight of oil of lubricating viscosity; a minor amount by weight of solid particles effective to improve the lubricating properties of the composition; and a minor amount by weight of a dispersant-VI improver.

As used herein the term "dispersant-VI improver" means a material, e.g., chemical compound, which acts to improve the dispersant properties of a lubricating oil composition and also acts to improve the viscosity index of the lubricating oil such that the inclusion of 1.5% by weight of a dispersant-VI improver in a lubricating oil which, alone, in a Reference Sequence VC Test has an "Average Overall Sludge Rating" and "Average Overall Varnish Rating" and a "Piston Skirt Varnish Rating" equal to between 7.5 and 8.3 increases each of such ratings by at least 0.3, preferably at least 0.5, and the inclusion of one (1) weight percent of such dispersant-VI improvers in a typical paraffinic lubricating oil having a viscosity index of 100 from viscosity measurements at 100° F. and 210° F., acts to increase the viscosity index of the resulting lubricating oil by at least 10 viscosity index units, preferably by at least 20 viscosity index units.

The incorporation of such dispersant-VI improvers into the present solid particles-containing compositions has been found to provide a surprising degree of reduction in detrimental deposit formation, e.g., on internal combustion engine components lubricated by the present compositions.

DETAILED DESCRIPTION OF THE INVENTION

The oils used in the compositions of the present invention are those conventionally used in lubricant manufacture. The suitable lubricating oils include those having a viscosity within the range of about 50 SUS to about 2000 SUS at 100° F. These oils may be refined or otherwise processed to produce an oil having the desired quality. Although mineral oils are preferred, the oil may be synthetic in nature. The oil used the present invention is preferably a mineral oil having a viscosity of about 100 SUS to about 1000 SUS at 100° F. Combinations of two or more different oils in a single lubricating composition are within the scope of the present invention. The lubricating oil comprises a major proportion, preferably at least about 60 percent still more preferably at least about 70 percent, by weight of the total composition.

The present compositions include a minor amount by weight of solid particles effective to improve the lubricating properties of the compositions. Preferably, a major portion, by weight, and more preferably substantially all, of such solid particles, have a maximum transverse dimension in the range of about 1 millimicron to about 2 microns, and most preferably in the range of about 1 millimicron to about 1 micron. Suitable solid particles for use in the present invention include those materials known to provide improved lubricating properties to lubricating oil compositions. Such solid particles include, for example, graphite, molybdenum disulfide, zinc oxide, tungsten disulfide, mica, boron nitrate, borax silver sulfate, cadmium iodide, lead iodide, barium fluoride, tin sulfide, mixtures thereof and the like. The solid particles useful in the present compositions are preferably selected from the group consisting of graphite, molybdenum disulfide, zinc oxide, and mixtures thereof; more preferably from the group consisting of graphite, molybdenum disulfide and mixtures thereof; and most preferably, graphite.

The solid particles are preferably present in the present compositions in an amount of about 0.05% to about 5%, more preferably about 0.1% to about 2%, by weight of the total composition, The solid particles component of the present composition is preferably prepared as a colloidal suspension, in, for example, a conventional lubricating oil and/or at least one conventional lubricating oil detergent. For example, such colloidal suspensions or concentrates may contain about 2% to about 25% or more, by weight of such solid particles.

Any conventional lubricating oil detergent may be used to aid in stabilizing these colloidal suspensions of the presently useful solid particles. Such detergents are often characterized as comprising at least one surface active compound which, when included in a lubricating oil composition tends to inhibit solid contaminants, e.g., combustion by-product present in the engine's lubricating oil, from adhering to metallic surfaces of engine components. Although both ash-containing, metal-based detergents and ashless detergents are useful as such solid particles-containing suspension, the ashless detergents are preferred.

There are many examples of ash-containing, metal-based detergents which are suitable in such solid particles-containing suspension. The ashless detergents preferred for use are compounds which comprise an oil-solubilizing tail and a polar detergent head. Many ashless detergents fitting this general description are known to the art and are commercially available.

Specific examples of this type of ashless detergent include the polyamino-polyalkylene alkenyl succinimides. Amine salts of alkyl phosphoric acids, are also suitable. Polyamine derivatives of long chained hydrocarbons may also be used. Reaction products of alkylene polyamines with long chained alkenyl succinic anhydrides and long chained esters of Mannich bases are suitable detergents. As can be seen, the required polarity may be supplied by groups containing, for example, oxygen, sulfur, phosphorous, nitrogen and mixtures thereof. All of these suitable ashless detergents may be generally characterized as compounds comprising at least one substantially hydrocarbon portion of sufficient size to render the compound oil-soluble and at least one non-metallic polar portion which when attached to the hydrocarbon portion provides a substantial part, often essentially all, of the detergent action.

To illustrate, specific examples of ashless detergents suitable for use as solid particles stabilizers include polyaminepolyalkylene alkenyl succinimines, long chain polyamines, dihydrocarbon substituted polyamines, substituted-phenol substituted polyamine products and mixtures thereof. These compounds may be represented by the following structures:

Polyamine-Polyalkylene Alkenyl Succinimides

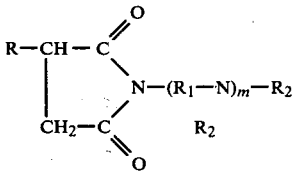

Long Chain Polyamines

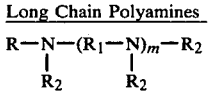

Dihydrocarbon Substituted Polyamines

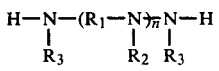

Substituted Phenol-Substituted Polyamine Products

-continued

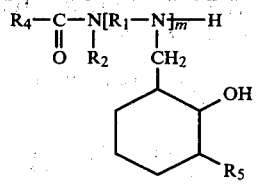

wherein R is a substantially hydrocarbon monovalent radical containing from about 30 to about 250 carbon atoms; each $R_1$ is an independently selected substantially hydrocarbon divalent radical containing from 1 to about 8 carbon atoms; each $R_2$ is independently selected from the group consisting of H and substantially hydrocarbon monovalent radicals containing from 1 to about 8 carbon atoms; each $R_2$ is an independently selected substantially hydrocarbon monovalent radical containing from about 15 to about 100 carbon atoms; $R_4$ is substantially hydrocarbon monovalent radical containing from about 4 to about 30 carbon atoms; m is an integer from 1 to about 10, preferably from 2 to about 10 and n is an integer from zero to about 10, preferably from about 2 to about 6.

It is preferred that R and $R_3$ be alkenyl, preferably selected from the group consisting of polypropenyl and polyisobutenyl. It is preferred that each $R_1$ be an independently selected alkylene radical containing from 1 to about 8, more preferably from 2 to about 6, carbon atoms. Suitable alkylene radicals from which each $R_1$ may be independently selected include methylene, ethylene, propylene, butylene, hexylene, octylene and the like. Although each $R_1$ may be independently selected, it is preferred that for any given ashless detergent all the $R_1$'s contained therein are the same radicals.

The substantially hydrocarbon monovalent radicals from which each $R_2$ may be independently selected each contain from 1 to about 8, preferably from 1 to about 4, carbon atoms. These substantially hydrocarbon radicals include alkyl, such as methyl, ethyl, propyl, butyl, hexyl, octyl and the like, alkenyl, such as ethenyl, propenyl, butenyl, hexenyl, octenyl and the like; aryl, alkaryl, aralkyl, alkenaryl and aralkenyl, such as phenyl, methyl phenyl, phenyl ethyl, ethenyl phenyl, phenyl ethenyl and the like.

The substantially hydrocarbon radicals from which $R_4$ is selected contain from 2 to about 30, preferably from about 4 to about 24, carbon atoms. These radicals may be straight chain or branched, saturated or unsaturated, aliphatic (including cycloaliphatic), aromatic or combinations thereof. Examples of suitable radicals include alkyl such as butyl, octyl, decyl, dodecyl, octadecyl, $C_{24}$ alkyl and the like; alkenyl such as butenyl, octenyl, dodecenyl, octydecenyl, $C_{24}$ alkenyl and the like; and aryl, alkaryl, aralkyl, alkenaryl, aralkenyl such as phenyl, benzyl, naphthyl, ethyl phenyl, decyl phenyl, octadecyl phenyl, phenyl butyl, phenyl decyl, phenyl octadecyl, butenyl phenyl, decenyl phenyl, octadecenyl phenyl, phenyl butenyl, phenyl decenyl, phenyl octadecenyl and the like. More preferably, $R_4$ is selected from the group consisting of alkyl and alkenyl containing from about 10 to about 24 carbon atoms.

Each $R_5$ is preferably independently selected from alkyl radicals containing from 4 to about 30, preferably from about 8 to about 20, carbon atoms. Examples of radicals from which each $R_5$ may be independently selected include amyl, octyl, decyl, octadecyl and the like.

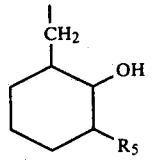

The portion of the substituted phenol substituted polyamine acid salts may be replaced by, for example, alkylnaphthols and similar derivatives of biphenyl, terphenyl, phenanthrene, anthracene and the like.

The term "substantially" hydrocarbon radicals referred to herein includes those radicals which are composed primarily of carbon and hydrogen and also includes radicals which contain, in addition, minor amounts of substituents, such as oxygen, halide, sulfur, nitrogen and the like which do not substantially affect the hydrocarbon character of the radicals.

The specific ashless detergents noted above, as well as other of the many suitable ashless detergent materials and methods for preparing these materials are described in the following U.S. Pat. Nos.: 3,237,614; 3,018,247; 3,513,093; 3,753,670; 3,008,993; 3,275,554; 3,473,011; 3,574,576; 3,576,743; 3,578,422; 3,597,174; 3,369,110; 3,652,240; 3,655,351; 3,658,494; 3,658,495; 3,676,089; 3,701,640; 3,711,255; 3,717,447; 3,728,091; 3,746,520; 3,751,255; 3,756,793; 3,762,889; 3,764,281; 3,765,850, 3,773,479; 3,752,657; 3,753,670; 3,779,724 and 3,782,912.

As noted herein before, the compositions of this invention require certain dispersant-VI improvers as defined hereinbefore.

Included among the useful dispersant-VI improvers are the following.

Co-polymers which are derived from the polymerization of (1) a N-vinyl pyrrolidone and (2) an oil soluble acrylic ester. These co-polymers preferably have molecular weights in the range of about 75,000 to about 1,500,000, more preferably, about 200,000 to about 1,000,000, and still more preferably about 700,000 to about 1,000,000. The molar ratio of N-vinyl pyrrolidone to oil-soluble acrylic ester in the presently useful co-polymers is preferably about 1:5 to about 1:15. In one preferred embodiment, the co-polymer is a graft co-polymer in which the N-vinyl pyrrolidone is grafted onto an oil soluble polymeric backbone prepared from at least one oil soluble acrylic ester.

N-vinyl pyrrolidones that may be used in the co-polymers useful in the composition of this invention may be represented by the structural formula:

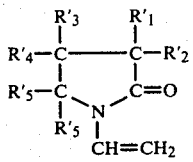

wherein $R'_1$, $R'_2$, $R'_3$, $R'_4$, $R'_5$ and $R'_6$ are independently selected from the group consisting of hydrogen and lower alkyl. Preferred lower alkyl groups contain from 1 to 4 carbon atoms. Preferably, each of the $R'_5$ is hydrogen.

Representative N-vinyl pyrrolidones within the scope of the above formula that are useful include N-vinyl pyrrolidone itself, 3-methyl-1-vinyl pyrrolidone, 4-methyl-1-vinyl pyrrolidone, 5-methyl-1-vinyl pyrrolidone, 3-ethyl-1-vinyl pyrrolidone, 3-butyl-1-vinyl pyrrolidone, 3,3-dimethyl-1-vinyl pyrrolidone, 4,5-dimethyl-1-vinyl pyrrolidone, 5,5-dimethyl-1-vinyl pyrrolidone, 3,3,5-trimethyl-1-vinyl pyrrolidone, 4-ethyl-1-vinyl pyrrolidone, 5-methyl-5-ethyl-1-vinyl pyrrolidone, 3,4,5-trimethyl-3-ethyl-1-vinyl pyrrolidone and other lower alkyl substituted N-vinyl pyrrolidones.

Also, within the scope of this invention are other cyclic N-vinyl amides such as N-vinyl caprolactam and its alkyl-substituted derivatives that may be included in the presently useful co-polymers, e.g., co-grafted onto the oil-soluble polymeric backbone.

The other essential monomer of the presently useful co-polymers is a material selected from alkyl acrylates, alkyl methacrylates or mixtures thereof with alkyl groups of sufficient average size to ensure solubility of the co-polymer, e.g., graft co-polymer, in the present lubricating oil composition. Oil-soluble acrylic esters useful as monomers, e.g., for forming the backbone polymer in the case of graft co-polymers, may be represented by the formula

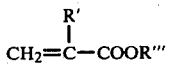

wherein R' represents hydrogen or methyl and R''' represents an oil solubilizing group, such as a substantially hydrocarbon radical containing about 8 to about 24 carbon atoms, especially an alkyl group of about 8 to about 24 carbon atoms. The alkyl group may be a straight chain or branched chain and preferably contains about 12 to about 18 carbon atoms. Representative acrylic and methacrylic esters that promote oil solubility comprise octyl, decyl, isodecyl, dodecyl, isododecyl, myristyl, cetyl, stearyl, eicosyl and tetracosyl acrylates and methacrylates.

The term "acrylic ester" in this invention includes both acrylates and methacrylates. Mixtures of both alkyl acrylates and alkyl methacrylates may be used.

In one preferred embodiment, lower alkyl acrylic esters, i.e., esters having alkyl groups smaller than about 8 carbon atoms and derived from acrylic or methacrylic acid, are used to replace a portion of the esters which have an oil solubilizing group. In general, they possess polymerizing characteristics similar to the acrylic esters which supply oil-solubility. Also, the presence of small alkyl groups in co-polymers may help improve such properties as pour point depression and viscosity index improvement. Typical lower acrylic esters are methyl, ethyl, propyl, butyl, amyl, and hexyl acrylates and methacrylates. These lower alkyl acrylic esters may be employed in amounts up to about 65% by weight of the total acrylates and/or methacrylates in the presently useful co-polymers.

In addition to the one or more of the above acrylic esters possessing oil-solubilizing groups and the aforementioned lower alkyl acrylic esters, there may be used to form the co-polymers, e.g., the backbone of the presently useful graft co-polymers, in minor amounts, one or more other miscellaneous free radically polymerizable monoethylentically unsaturated compounds, particularly monovinylidene compounds, i.e., those having one $CH_2{=}C<$ group. These include substantially hydrocarbon, e.g., alkyl, esters of maleic, fumaric, and taconic acids (including half esters thereof), acrylic acid, methacrylic acids, maleic anhydride, acrylic amides, maleic half amides, acrylonitrile, methacrylonitrile, vinyl alkyl ethers, vinyl alkyl thioethers, styrene, alkylstyrenes, and lower alkyl acrylic esters.

The substantially hydrocarbon groups in these other esters and in the ethers may be small or large. For example, alkyl groups containing 1 to about 20 carbon atoms, e.g., methyl, butyl, octyl, nonyl, and dodecyl to octadecyl and mixtures thereof, may be employed. Half esters of dicarboxylic acids are of interest in supplying both the ester function and the acid function, which is often desired and which can be converted to a salt form, as with barium, strontium, calcium, or magnesium. Such miscellaneous co-monomers are used in minor proportions and in amounts which do not interfere with oil-solubility of the final co-polymer. Of course, those having larger hydrocarbon groups may also assist in imparting oil-solubility.

In a similar way, there may be used in minor proportion polymerizable esters in which in place of an alkyl group, there may be used a cyclic-containing residue of an alcohol or ester-forming equivalent, typical whereof are phenyl, alkylphenyl, benzyl, cyclohexyl, alkylcyclohexyl, cyclopentyl, and dicyclopentyl. Similarly, the alcohol residue used for forming a polymerizable ester or ether may contain a heteroatom, such as oxygen, sulfur, nitrogen, halogen, phosphorus and the like. Typical of these groups are methoxyethyl, ethoxyethyl, methylthiomethyl, butoxyethyl, ethoxypropyl, methylthioethyl, chloropropyl, 4-chlorobutyl, butyoxybutyl, phenoxyethyl, octylphenoxyethyl in which there are up to about 30 or more ether groups, cyclohexoxypropyl, benzoxyethyl, dodecylthioethoxyethyl, 2-(ethylsulfinyl) ethyl, butylsulfinylethyl, phenylsulfinylmethyl, dimethylaminoethyl, dibutylaminoethyl, tert-butylaminoethyl, dimethylaminoethoxyethyl, diethylphosphatoethyl, or diethylphosphonomethyl.

Typical vinyl ethers are vinyl butyl ether, vinyl octyl ether, vinyl dodecyl ether, vinyl hydroxyethyl thioether, and vinyl tetradecyl thioether. In place of vinyl alkyl ethers there may be used vinyl ethers having a ring substituent as in vinyl phenyl ether, vinyl benzyl ether, or vinyl cyclohexyl ether.

Polymerizable amides of chief interest are acrylamide, methacrylamide, and their N-substituted derivatives, including such compounds as N-methyl, N-dimethyl, N-octyl, N-dodecyl, N-cyclohexyl, N-phenyl, N-methyl-N-benzyl, N-butoxymethyl, N-(dimethylaminoethyl), or N-B-cyanoethyl acrylamide or methacrylamides.

Up to about 25% based on the weight of the final co-polymer of such miscellaneous monomer or monomers may be used, if desired, but such use is optional.

To prepare the presently useful graft co-polymers, the backbone polymer, which may be formed using conventional techniques well known in the art, containing at least one acrylic and/or methacrylic ester supplying oil-solubility, with or without other polymerizable monoethylenically unsaturated compounds, is treated with a free radical polymerization initiator. This initiator may be, for example, an organic peroxide or hydroperoxide or an azo catalyst. An especially effective initiator system comprises an organic hydroperoxide coupled with a quaternary ammonium compound as activator. Graft polymerization may be effected in bulk or in an organic solvent, especially in an organic solvent in which polymers are soluble. Use of such solvent decreases viscosity of the mixture and permits a more efficient polymerization reaction.

Among solvents which may desirably be used are aromatic hydrocarbons, such as benzene, toluene, xylene, and aromatic naphthas, chlorinated hydrocarbons such as ethylene dichloride, esters such as ethyl propionate or butyl acetate, and also petroleum oils which are pure enough so as not to interfere with the polymerization. Solvent may be retained with the final polymer or it may be removed therefrom. The final co-polymer in solvent may be mixed with a good quality mineral oil, such as 100 to 150 neutral oil, or with a synthetic lubricant and the volatile solvent evaporated from the mixture to give a solution of co-polymer in oil or synthetic lubricant, such as dioctyl sebacate, dibutylphenyl phosphate, a silicate ester, or a silicone fluid.

The N-vinyl pyrrolidone monomer is heated with initiator in the presence of the backbone polymer to a polymerizing temperature, preferably between about 60° C. and about 225° C. Choice of temperature or range of temperature depends in part upon the initiator system to be used and upon such other factors as choice of monomer, solvent, and concentrations. Graft polymerization may be initiated at one temperature and continued at other temperatures. Initiator or initiator and activator may be added in portions. Different polymerization initiators may be used at different stages of polymerization during which solvent may be supplied or removed.

As initiator there is preferably used an organic hydroperoxide such as tert-butyl hydroperoxide, cumene hydroperoxide, diisopropylbenzene hydroperoxide, p-methane hydroperoxide, pinane hydroperoxide, 2,5-dimethylhexane-2,5-dihydroperoxide, or other tert-alkyl hydroperoxides, hydrocarbon-substituted benzene hydroperoxides, or terpene hydroperoxide. The initiator may be supplied as a single charge or added in portions as polymerization progresses.

Hydroperoxides become active as initiators at lower temperatures when used in conjunction with an activator. Especially useful activators are quaternary ammonium compounds, such as benzyltrimethylammonium chloride, dibenzyldimethylammonium bromide, butyldimethylbenzylammonium chloride, cetyltrimethylammonium chloride, dodecyldimethylbenzylammonium chloride, dodecylbenzyldimethylbenzylammonium chloride, didodecenyldimethylammonium chloride, benzyldimethyldodecenylammonium chloride, octylphenoxyethyldimethylbenzylammonium chloride, nonylphenoxyethoxyethyltrimethylammonium chloride, diisobutylphenoxyethoxyethyldimethylbenzylammonium chloride, cetylpyridium bromide, N-octyl-N-methylmorpholinium chloride, and bis-quarternary ammonium salts, such as those having quaternary nitrogens linked with an alkylene chain, an amide-containing chain, or an ether-containing chain.

In place of a hydroperoxide or a hydroperoxide-activator system there may be used other free radical polymerization initiators. These include peroxides such as benzoyl peroxide, acetyl peroxide, caproyl peroxide, lauroyl peroxide, di-tert-butyl perphthalate, tert-butyl perbenzoate, 2,2-bis(tert-butyl-peroxy) butane, or methyl ethyl ketone peroxide. There may likewise be used an azo catalyst such as azodiisobutydimethyl azodiisobutylate, azobis (a-ethylbutylnitrile), or azobis (a,B-dimethylcapronitrile). The amount of initiator or initiators is preferably between about 0.01% and about 5% of the weight of monomers used.

The compositions of the present invention preferably contain about 2% to about 12% by weight (based on the total composition) of at least one of the above-described co-polymers, more preferably, about 3% to about 10% by weight of the total composition. In any event, the amount by weight of such copolymers in the compositions of this invention is at least equal to the amount of solid particles, e.g., graphite, molybdenum disulfide and the like, present. Preferably, the amount of co-polymer is at least about 2 times, more preferably at least about 3 times, the amount of solid particles.

Another example of a dispersant-VI improver is a functional polymer lubricant additive. Such additives are prepared by reacting simultaneously, at a temperature of about 140°-350° F. an oxidized co-polymer of essentially ethylene and propylene with an aliphatic amine or polyamine, and recovering the resultant reaction product; said reactants being employed in the molar ratio of from about 1:2 to about 1:20.

In other embodiments, an aldehyde is also employed in such additives. In this embodiment, the functional polymer additive is prepared by reacting simultaneously, at a temperature of about 250°-350° F., an oxidized co-polymer of ethylene and propylene with a formaldehyde-yielding reactant, and an aliphatic amine or polyamine, and recovering the resultant reaction product; said reactants being employed in the molar ratio of from 1:2:2 to about 1:20:20.

In the preparation of the functional polymeric additives employed in this invention it is desirable to conduct the reaction in the presence of a non-reactive organic solvent or diluent, such as, for example, an aromatic hydrocarbon solvent, e.g., benzene, xylene, toluene, etc., or an aliphatic hydrocarbon solvent, such as, for example, hexane. Particularly suitable as a solvent or diluent is a low viscosity hydrocarbon oil, such as a solvent extracted SAE 5W mineral oil. The use of a solvent or diluent is advantageous to facilitate the mixing of the reactants, and in the control of the reaction temperatures.

With respect to these functional polymer additives the term "co-polymer" refers to amorphous co-polymers derived from essentially ethylene and propylene: however, such co-polymers may contain minor amounts, i.e., up to 10 percent, based on the molar amounts of the monometric ethylene and propylene units in the co-polymer, of polymerized units derived from other olefin monomers. Such other olefinic monomers include olefins in the general formula $RCH\text{-}CH_2$, in which R is an aliphatic or cycloaliphatic radical of form 2 to about 20 carbon atoms, for example, butene-1, hexene-1,4-menthyl-pentene, decene-1, vinylidene norbornene, 5-methylene-2-norbornene, etc. Other olefinic monomers having a plurality of double bonds may be used, in particular diolefins containing from about 4 to about 25 carbon atoms, e.g., 1,4-butadiene, 1,3-hexadiene, 1,4-pentadiene, 2-methyl 1,5-hexadiene, 1,7-octadiene etc.

Suitable ethylene-propylene co-polymers contain from about 30 to about 65, preferably from about 35 to about 45 mole percent propylene, have a number average molecular weight of at least about 20,000, e.g., from about 21,500 to about 200,000 or more, and preferably from about 25,000 to about 40,000, and contain at least 140, and more preferably at least 150, pendant methyl groups per 1,000 chain carbon atoms.

A particularly suitable ethylene-propylene co-polymer is one having the following chacteristics:

| | |
|---|---|
| Number average molecular weight | 25,000–35,000 |
| Percent (Molar) propylene monomer | 38–42 |
| Pendant Methyl Groups per 1,000 Chain Carbon Atoms | 160–170 |
| Inherent Viscosity | 1.7–2.0 (A) |
| Gardner Viscosity | U–V (B) |
| Mooney Viscosity | 20–35 (C) |

(A) 0.1 gram copolymer in 100 cc decalin at 135° C.
(B) 8.0% co-polymer in toluene at 25° C.
(C) ASTM D-1646

Methods of preparation of the co-polymers are well-known; such methods are described in many United States Patents, such as, among others, U.S. Pat. Nos. 2,700,633; 2,726,231; 2,792,288; 2,933,480; 3,000,866; 3,063,973; 3,093,621 and others.

The oxidation of the co-polymer can be accomplished by contacting the co-polymer under suitable conditions of temperature and at atmospheric or elevated pressures, with an oxidizing agent such as air or free oxygen, or any oxygen containing material capable of releasing oxygen under the oxidation conditions. If desired, the oxidation can be conducted in the presence of known oxidation catalysts such as platinum or a planinum group metal, and compounds containing metals such as copper, iron, cobalt, cadmium, manganese vanadium etc. The oxidation can be carried out by methods described in U.S. Pat. Nos. 2,982,728; 3,316,177; 3,153,025; and 3,365,499, and 3,544,520.

Generally, the oxidation can be carried out over a wide temperature range, depending upon the oxidizing agent used; for example, with an active oxidizing agent, e.g., $SO_3$, temperatures in the range of −40° F. to 400° F. have been used, while with less active oxidizing agents, e.g., air, temperatures in the range of 100°-800° F. have been used. Further, depending upon the rate desired, the oxidation can be conducted at sub-atmospheric, atmospheric or super-atmospheric pressures, and in the presence or absence of oxidation catalysts. The conditions of temperature, pressure, oxygen content of the oxidizing agent, the rate of introducing the oxidizing agent, the catalyst employed, if any, etc., are correlated and controlled by those skilled in the art, so as to obtain the desired optimum results.

The following will illustrate one method of oxidizing the co-polymer; to a co-polymer of ethylene and propylene (1 part), having a number average molecular weight of about 28,000, is added a solvent-extracted SAE 5W mineral oil (9 parts) in an open reaction vessel, and the mixture slowly stirred and heated at a temperature of 360° F., under an inert gas atmosphere, until solution of the rubber-like polymer in the solvent is effected. Maintaining the 360° F. temperature, the mixture is rapidly agitated in an atmosphere composed of 50 percent air and 50 percent nitrogen, to promote the oxidation of the co-polymer. A 50:50 air-nitrogen ratio is used to preclude the possibility of an explosive mixture being formed. Reaction in the described manner is continued for 2.5–4.0 hours. About 2.5–4.5 oxygen atoms per molecule of the co-polymer are introduced under such oxidation conditions.

The amine reactant used in the preparation of the functional polymers of the present invention are primary or secondary aliphatic amines and diamines or the general formula $H_2N(CH_2)_yNH_2$, wherein y is an integer 3 to 10, said amines and diamines containing up to about 10 carbon atoms in the alkyl group, the polyalkylene polyamines of the general formula

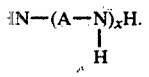

wherein A is a divalent alkylene radical of about 2 to about 6 carbon atoms, and x is an integer from 1 to about 10. Illustrative of suitable amines are: methylamine, dibutylamine, cyclohexylamine, propylamine decylamine, ethylene diamine, trimethylene diamine, tetramethylene diamine, hexamethylene diamine, diethylene triamine, triethylene tetramine, tetraethylene pentamine, tripropylene tetramine, tetrapropylene pentamine, and other polyalkylene polyamines in which the alkylene groups contain suitably up to about 10 carbon atoms.

Illustrative of aldehydes suitable for use in accordance with the other embodiment of the present invention are aliphatic aldehydes such as, for example, formaldehyde, acetaldehyde, B-hydroxybutyraldehyde. Preferred are formaldehyde or a formaldehyde-yielding compound such as paraformaldehyde and formalin.

Although average molecule weights in the range from about 1,500 to about 20,000 are suitable, preferably, the aminated oxidized co-polymers have number average molecular weights in the range of from about 20,000 to about 200,000, or more, and most preferably in the range of from about 25,000 to about 40,000.

The chemical composition of the reaction product which comprise the functional polymers cannot be characterized with preciseness by chemical structural formula. However, it is believed that the oxidation of the co-polymer produces predominately ketones, and minor amounts of aldehydes, acids and perhaps esters. As a result of the complex nature of the oxidized reaction product, the precise composition of such product cannot be defined by its chemical structure, but rather must be defined by its method of preparation.

Other examples of a dispersant-VI improvers are certain nitrogen-containing polymers.

One preferred nitrogen-containing polymer is a graft polymer having a dialkylaminoalkyl-methacrylate, or mixtures thereof, grafted to the polymer backbone.

A second preferred nitrogen-containing polymer is an oil soluble interpolymer prepared from a long chain n-alkyl methacrylate and a dialkylaminoalkylmethacrylate or a N(alkanone) acrylamide.

The nitrogen-containing graft polymers useful in the present invention may be prepared using conventional methods well known in the art. For example, one such method involves a two stage procedure.

The first stage comprises contacting an oil soluble substantially linear terpolymer of ethylene, a terminally unsaturated straight chain alkene of 3 to about 12 carbons and a terminally unsaturated non conjugated alkadiene of 5 to about 8 carbons, the terpolymer reactant having an average carbon chain length of about 700 to about 7000 and an inherent viscosity of about 0.6 to about 1.9 at 0.10 wt.% solution in tetrachloroethylene at 30° C. with an alkyl lithium of 3 to about 10 carbon atoms in the presence of a liquid alkane, as solvent, of about 5 to about 10 carbon atoms and N,N,N',N' tetralkylalkylene diamine promoter wherein the alkyl and alkylene moieties in the diamine are from 1 to about 4 carbons to form a lithiated terpolymer intermediate. The first stage contacting is preferably conducted under anhydrous conditions (less than 0.01 wt.% water) and in an inert atmosphere, e.g., nitrogen and at a temperature between about 20° and 100° C. for a period of between 1 and 25 hours. The first stage contacting preferably involves about 10 to about 200 moles alkyl lithium/100 g. of terpolymer and a mole ratio of alkyl lithium to diamine promoter of about 0.40 to about 2.0.

In the second stage the lithiated hydrocarbon terpolymer intermediate is contacted with a aminoalkyl methacrylate monomer of the formula:

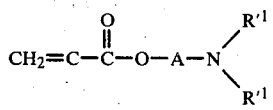

where $R'^1$ and $R'^2$ are alkyl of 1 to 2 carbons and A is a divalent alkylene radical of 2 to about 4 carbons, preferably at a temperature between about 100° C. and −100° C. under anhydrous conditions and in an inert atmosphere utilizing a weight ratio of lithiated intermediate to total monomer reactant of about 0.2:1 to about 1000:1. The reaction period in the second stage is preferably between about 0.5 and 24 hours.

The graft polymer products is recovered from final reaction mixture by standard means, e.g., adding a lower alkanol having from 1 to 4 carbon atoms in quantities of between about 0.1 and 10 wt.% of the reaction mixture to destroy the alkyl lithium and diamine promoter followed by washing the solution with dilute aqueous mineral acid, (e.g., 5 10 wt. % aq. HCl) and then with water followed, if desired, by further standard purification techniques such as precipitation.

In the first stage of the reaction lithium moieties are randomly placed along the terpolymer chain, the lithiated locations being where the polymethacrylate graft component attaches via replacement of the lithium moieties.

Examples of the alkene component in the terpolymer reactant include propylene, 1-butene, 1-pentene, 1-hexene, 1-heptene, 1-octene, 1-nonene, 1-decene, and 1-dodecene. Suitable alkadiene components in said terpolymer reactant include 1,4-pentadiene, 1,4-hexadiene, 1,5-hexadiene, 2-methyl, 1,5-hexadiene, 1,6-heptadiene and 1,7-octadiene. More preferably, the terpolymer is derived of about 40 to 55 wt.% ethylene, about 40 to 60 wt.% propylene and about 1 to 5 wt.% 1,4-hexadiene and has a carbon atom chain length of about 800 and about 5000. Excellent results are obtained wherein the terpolymer reactant contains 50.5 wt. % ethylene, 46 wt.% propylene and 3.5 wt.% 1,4-hexadiene and has a carbon atom chain length of between about 900 and 2600.

Examples of suitable dialkylaminoalkyl methacrylate monomers, are the N,N-dimethylaminoethyl methacrylate, N,N-diethylaminoethyl methacrylate, N,N-diemethylaminopropyl methacrylate and N,N-diethylaminophopyl methacrylate.

Examples of suitable alkyl lithium are butyl lithium, hexyl lithium, octyl lithium and decyl lithium.

Examples of suitable N,N,N',N',-tetraalkylalkylenediamines are N,N,N',N',-tetramethylethylene diamine, N,N,N',N'-tetramethylpropylene diamine, N,N,N',N'-tetramethylbutylene diamine, and N,N,N',N'-terrabuthlmethylene diamine.

Examples of suitable inert reaction solvents are hexane, cyclohexane and heptane.

The nitrogen-containing interpolymers suitable for use in the combination of the present invention is an oil soluble interpolymer prepared from a long chain n-alkyl-methacrylate and a dialkylaminoalkylmethacrylate or a N(alkanone) acrylamide. Preferably the interpolymer has a number average molecular weight below about 120,000. These interpolymers are prepared by the complete polymerization of the monomer or mixtures thereof by conventional bulk, solution, or dispersion polymerization methods involving known polymerization catalysts, e.g., azo catalysts, such as azobisisobutronitrile of U.S. Pat. No. 2,471,959 or the well known peroxide catalysts such as benzoyl peroxide and lauryl peroxide, utilized in catalyst quantities of between about 0.1 and 5 wt. percent. Polymerization is normally conducted at a temperature between about 50° C. and 150° C. preferably at 80°-100° C., and usually carried out in an inert atmosphere such as nitrogen or carbon dioxide to prevent undesirable oxidation. During polymerization, samples are taken periodically for refractive index determination. The polymerization reaction is continued until the refractive index remains relatively steady with the normal reaction time taken between 1 and 10 hours.

The monomers utilized to prepare the useful nitrogen-containing interpolymers include n-alkylmethacrylates and a dialkylaminoalkylmethacrylate or a N(alkanone) acrylamide. The n-alkylmethacrylate monomers are generally selected from those which contain from about 4 to about 22, preferably about 12 to about 18, carbon atoms in the aliphatic hydrocarbon chain. These methacrylates are prepared by standard esterification techniques through the reaction of methacrylic acid with technical grades of long chain primary alcohols. These commercially available alcohols are mixtures of n-alkanols of various chain lengths containing between about 4 and 22 carbons in the alkyl group. Several suitable sources of these alcohols mixtures and the technical grade alcohols sold under the tradename "Neodols" by Shell Chemical Corporation and under the tradename "Alfols" by Continental Oil Company. Typical analysis of two useful alcohols are set forth below:

| | Typical Properties Approx. homolog distribution, wt. % |
|---|---|
| Neodol 25L (Synthetic Lauryl Alcohol) lighter than $C_{12}OH$ | |
| $C_{12}OH$ | 4 |
| $C_{13}OH$ | 24 |
| $C_{14}OH$ | 24 |
| $C_{15}OH$ | 24 |
| $C_{16}OH$ | 2 |
| Alfol 1620 SP (Synthetic stearyl alcohol) | |
| $C_{14}OH$ and lighter | 4 |
| $C_{16}OH$ | 55 |
| $C_{18}OH$ | 27 |
| $C_{20}OH$ | 9 |

One of the nitrogen-containing monomers which can be employed to a suitable nitrogen-containing interpolymer used in this invention is a dialkylaminoalkylmethacrylate. A preferred dialkylaminoalkylmethacrylate is a di$C_1$-$C_6$ alkylamino $C_1$-$C_6$ alkylmethacrylate. Specific examples of these useful methacrylate monomers are diethylaminopropylmethacrylate, dimethylaminoethylmethacrylate, the propylaminoethacrylates and the butylaminobutylmethacrylates,. We find that dimethylaminoethylmethacrylate is particularly useful.

Another suitable nitrogen-containing monomer is an acrylamide. Preferred acrylamides are N(1,1-dimethylbutan-3-one) acrylamide and N(1,2-dimethyl-1-ethylbutan-3-one) acrylamide.

The compositions of the present invention preferably contain about 0.1% to about 12% by weight (based on the total composition) of at least one of the above-described nitrogen-containing polymers, more preferably, about 3% to about 10% by weight of the total composition. The amount by weight of such nitrogen-containing polymers in the composition of this invention is at least equal to the amount of solid particles, e.g., graphite, molybdenum disulfide and the like, present. More preferably, the amount of polymer is at least about 2 times and most preferably at least about 3 times, the amount of solid particles.

Further examples of dispersant - VI improvers include certain nitrogen-containing esters of carboxy interpolymers. The preferred nitrogen-containing mixed ester of a carboxy-containing interpolymer is a polymer having a reduced specific viscosity of about 0.05 to about 2. The interpolymer is characterized by the presence with its polymeric structure carboxylic acid ester groups having at least 8 aliphatic carbon atoms in the ester radical. The preferred interpolymer is characterized by the presence within its polymeric structure of at least one of each of three pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonyl-polyamino group derived from a polyamino compound having one primary or secondary amino group, wherein the molar ratio of (A):(B)"(C) is about (60-90):(10-30):(2-15)

It is preferred that the ester be a mixed ester, i.e., one in which there is the combined presence of both a high molecular weight ester group and a low molecular weight ester group, particularly in the ratio as stated above.

In reference to the size of the ester groups, the ester radical is represented by the formula

—C(O) (OR')

and the number of carbon atoms is an ester radical is thus the combined total of the carbon atom of the carbonyl group and the carbon atoms of the ester group, i.e., the (OR') group.

Another important element of the nitrogen-containing ester interpolymer is the presence of a carbonyl-polyamino group derived from at least one nitrogen-containing compound selected from the group consisting of (1) polyamino compound having one primary or secondary amino group, (2) hydrazine or a hydrocarbon-substituted hydrazine or (3) mixtures thereof.

Still another important element of the present invention is the extent of esterification in relation to the extent of neutralization of the unesterfied carboxy groups of the carboxy-containing interpolymer through the conversion thereof to polyamino-containing groups. For convenience, the relative proportions of the high molecular weight ester group to the low molecular weight ester group and to the polyamino group are expressed in terms of molar ratios of about (60-90):(10-30):(2-15), respectively. The more preferred ratio is about (70-80):(19-25):5. It should be noted that the linkage described as the carbonyl-polyamino groups may be amide, imide, or amidine, and inasmuch as any such linkage is contemplated within the present invention, the term "carbonyl-polyamino" is employed to designate the amino group in defining the interpolymers employed in the compositions of this invention.

Still another important aspect of the mixed ester interpolymer is the molecular weight of the interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$RSV = (\text{Relative Viscosity-1} / \text{Concentration})$$

wherein the relative viscosity is determined by measuring, by means of a dilution viscometer, the viscosity of a solution of one gram of the interpolymer in 100 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, Principles of Polymer Chemistry (1953 Edition) pages 308 et seq.

While interpolymers having a reduced specific viscosity in the range of about 0.05 to about 2 are contemplated for use in the present invention, the preferred interpolymers are those having a reduced specific viscosity in the range of about 0.3 to about 1. In most instances, interpolymers having a reduced specific viscosity in the range of about 0.5 to about 1 are particularly useful.

From the standpoint of utility, as well as for commercial and economical reasons, nitrogen-containing mixed esters in which the high molecular weight ester group has about from about 8 to about 24 aliphatic carbon atoms, the low molecular weight ester group has from about 3 to about 5 carbon atoms are preferred.

Specific examples of the high molecular weight carboxylic ester group, i.e., the (OR') group of the ester radical (i.e., —(O) (OR')) include heptyloxy, isooctyloxy, decyloxy, dodecyloxy, tridecyloxy, pentadecyloxy, octadecyloxy, eicosyloxy, tricosyloxy, tetracosyloxy, heptacosyloxy, triacontyloxy, hentriacontyloxy, tetracontyloxy, etc. Specific examples of low molecular weight groups include methyloxy, ethyloxy, n-propyloxy, isopropyloxy, n-butyloxy, see-butyloxy, iso-butyloxy, n-pentyloxy, neo-pentyloxy, n-henyloxy, cyclehexyloxy, cyclopentyloxy, 2-methy-butyloxy, 2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc.

The carbonyl polyamino group of the nitrogen-containing esters of this invention comprise groups derived from (1) polyamino compounds having one primary or secondary amino group, and (2) hydrazine and/or hydrocarbon-substituted hydrazine.

Preferred polyamino compounds for forming these groups are primary-aminoalkyl substituted tertiary amines, hetercyclic amines are particularly preferred.

Examples of the carbonyl polyamino group include those derived from polyaminocompounds having one primary or secondary amino group and at least one monofunctional amino group such as tertiary-amino or heterocyclic amino group. Such compounds may thus be tertiary amino substituted primary or secondary amines or other substituted primary and secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenolthiazines, amidines, etc. Examples of such polyamino compounds include dimethyl-amino-ethylamine, dibutylamino-ethylamine,, 3-dimethyl-amino-1-propylamine, 4-methylethylamino-1-butylamine, pyridyl-ethlamine, N-morpholino-ethylamine, tatrahydropyridyl-ethlamine, bis-(dimethylamino) propylamine, bis-(diethylamino)ethylamine, N,N-dimethyl-p-phenylene di-amine, piperidyl-ethylamine, 1-aminoethyl pyrazone, 1-(methylamino)pyrazoline, 1-methyl-4-aminooctyl pyrazole, 1-aminobutyl imidazole, 4-aminoethyl thiazole, 2-aminoethyl triazine, dimethylcarbamyl propylamine, N-methyl-N-aminopropyl acetamide, N-aminoethyl succinimide, N-methylamino maleimide, N-aminobutyl-alpha-chlorosuccinimide, 3-aminoethyl uracil, 2-aminoethyl pyridine, orthy-aminoethyl-N,N-dimethylbenzenesulfamide, N-aminoethyl phenothiazine, N-aminoethylacetamidine, 1-aminophenyl-2-methyl-imidazoline, N-methyl-N-aminoethyl-S-ethyldithiocarbamate, etc. For the most part, the polyamines are those which contain only one primary amino or secondary-amino group and, preferably at least one tertiary-amino group. The tertiary-amino group is preferably a heterocyclic amino group. In some instances polyamino compounds may contain up to about 6 amino groups although, in most instances, they contain one primary amino group and either one or two tertiary-amino groups. The polyamino compounds may be aromatic or aliphatic amines and are preferably heterocyclic amines such as amino-alkyl-substituted morpholines, piperazines, pyridines, benzopyrroles, quinolines, pyrroles, etc. They are usually amines having from about 4 to about 30 carbon atoms, preferably from about 4 to about 12 carbon atoms. Polar substituents may likewise be present in the polyamines.

The carbonyl-polyamino groups of the nitrogen-containing esters of this invention can also comprise the groups derived from hydrazine and/or a hydrocarbon-substituted hydrazine including, for example, the mono-, di-, tri-, and tetrahydrocarbon-substituted hydrazines wherein the hydrocarbon substituent is either an aliphatic or aromatic substituent including, for example, the alkyl-, e.g., cyclic and/or acrylic groups, aryl-, alkylaryl-, aralkyl, etc. The hydrocarbon substituents, generally, contain up to about 24 aliphatic carbon atoms and preferably up to about 12 aliphatic carbon atoms. The preferred substituents, however, include, for example, phenyl, alkylphenyl or an alkyl group wherein the alkyl is either a methyl, ethyl, propyl, butyl, pentyl, octyl, cyclohexyl, decyl or dodecyl, etc. Other examples of the hydrocarbon groups include octyldecyl, behenyl, benzyl, heptaphenyl, α-naphthyl, β-naphthyl, butyl-naphthyl, oleyl, stearyl, etc. Of the various hydrocarbon-substituted hydrazines, a preferred class includes the N,N-dihydrocarbon-substituted hydrazines, e.g., the dimethyl, diethyl, diphenyl and dibutyl hydrazines.

The carboxy-containing interpolymers include principally interpolymers of α, β-unsaturated acids or anhydrides such as maleic anhydride or itaconic anhydride with olefins (aromatic or aliphatic) such as ethylene, propylene, styrene, or isobutene. The styrene-maleic anhydride interpolymers are especially useful. They are obtained by polymerizing equal molar amounts of styrene and maleic anhydride, with or without one or more additional interpolymerizable comonomers. In lieu of styrene, an aliphatic olefin may be used, such as ethylene, propylene, isobutene. In lieu of maleic anhydride, acrylic acid or methacrylic acid or ester thereof may be used. Such interpolymers are known in the art and need not be described in detail here. Where an interpolymerizable comonomer is contemplated, it should be present in a relatively minor proportion, e.g., less that about 0.3 mole, usually less than about 0.15 mole, per mole of either styrene or maleic anhydride. Various methods of interpolymerizing styrene and maleic anhydride are known in the art and need not be discussed in detail here. For purpose of illustration, the interpolymerizable comonomers include the vinyl monomers such as vinyl acetate, acrylonitrile, methacrylate, methylmethacrylate, acrylic acid, vinyl methyl ether, vinyl ethyl ether, vinyl chloride, isobutene or the like.

The preferred nitrogen-containing mixed esters are most conveniently prepared by first esterifying the carboxy-containing interpolymer with a relatively high molecular weight alcohol and a relatively low molecular weight alcohol to convert at least about 50% and no more than about 98% of the carboxy radicals of the interpolymer to ester radicals and then neutralizing the remaining carboxy radicals with a polyamine such as described above. To incorporate the preferred amounts of the two alcohol groups into the interpolymer, the ratio of the high molecular weight alcohol to the low molecular weight alcohol used in the process should be within the range of about 2:1 to about 9:1 on a molar basis. In most instances the ratio is in the range of about 2.5:1 to about 5:1. More than one high molecular weight alcohol or low molecular weight alcohol may be used in the process; so also may be used commercial alcohol mixtures such as the so-called Oxo alcohols with comprise, for example, mixtures of alcohols having from 8 to about 24 carbon atoms. A particularly useful class of alcohols are the commercial alcohols or alcohol mixtures having at least 7 aliphatic carbon atoms including octyl alcohol, decyl alcohol, dodecyl alcohol, tetradecyl alcohol, pentadecyl alcohol, eicosyl alcohol, and octadecyl alcohol. Other alcohols useful in the process are illustrated by those which, upon esterification, yield the ester groups exemplified above.

The extent of esterification, as indicated previously, may range from about 50% about 98% conversion of the carboxy radicals of the interpolymer to ester radicals to provide a partially esterified interpolymer. In a preferred embodiment, the degree of esterification ranges from about 75% to about 95%.

The esterification can be accomplished simply by heating the carboxy-containing interpolymer and the alcohol or alcohols under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and an esterification catalyst such as toluene sulfonic acid, sulfuric acid, aluminum chloride, boron trifluoridetriethylamine, hydrochloric acid, ammonium sulfate, phosphoric acid, sodium methoxide or the like. The conditions and variations thereof are well known in the art.

A particularly desirable method of effecting mixed esterification involves first reacting the carboxy-containing interpolymer with the relatively high molecular weight alcohol and then reacting the partially esterified interpolymer with the relatively low molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event, a two-step esterification process whereby the carboxy-containing interpolymer is first esterified with the relatively high molecular weight alcohol so as to convert from about 50% to about 75% of the carboxy radicals to ester radicals and then with the relatively low molecular weight alcohol to achieve the finally desired degree of esterification provides preferred interpolymers.

The unesterified carboxylic radicals in the partially esterified interpolymer are then reacted with a nitrogen-containing compound; e.g., polyamino compound and/or hydrazine, to provide the nitrogen-containing esters of the invention.

For example, the esterified interpolymer can be treated with a polyamino compound in an amount so as to neutralize substantially all of the unesterified carboxy radicals of the interpolymer. The neutralization is preferably carried out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the polyamino compound is often desirable, so as to insure substantial completion of neutralization, i.e., no more than about 2% of the carboxy radicals initially present in the interpolymer remained unneutralized and most preferably the resulting ester is substantially free of titratable acidity.

The unesterified carboxylic radicals can also be reacted with a small but effective amount of hydrazine or a hydrocarbon-substituted hydrazine to form the carbonylpolyamino group. The hydrazines may be used in the form of a hydrate, hydrohalide, sulfate, hydrosulfate, etc. The reaction with hydrazine or a hydrocarbon-substituted hydrazine proceeds suitably at temperatures ranging from about 80° to 300° C. The reaction temperatures may range from about 80° C. to 350° C. or higher provided that said temperature is maintained below the decomposition point of either the reactants or the products obtained thereof.

Thus, for example, at least about 50 mole percent, e.g., 50–98 mole percent, of the carboxyl groups of a styrenemaleic interpolymer may be esterified with a high molecular weight aliphatic alcohol and then subsequently reacted with hydrazine, etc., to obtain a nitrogen-containing ester having about 2.0 to 50 or 2.0 to 35 molar percent of the carboxylic groups converted to carbonyl-polyamino groups. The alcohol-esterified interpolymer is preferably reacted with hydrazine or a hydrocarbon-substituted hydrazine to substantially neutralize all of the unesterified carboxy radicals of the interpolymer. The reaction with hydrazine is preferably carried out at temperatures ranging from about 100°–350° C. In most instances, however, the neutralization reaction takes place at temperatures ranging from about 150°–250° C. in the presence of an excess of the hydrazine. A stoichiometric excess is particularly useful where it is desirable to neutralize substantially all of the unesterified carboxy radicals present in the carboxy interpolymer.

Suitable nitrogen-containing esters of carboxy interpolymers are disclosed in U.S. Pat. Nos. 3,702,300; 3,956,149 and 3,959,159 incorporated by reference herein.

The compositions of the present invention preferably contain about 0.1 to about 20% by weight (based on the total composition) of at least one of the dispersant-VI improvers required by this invention, more preferably, about 3% to about 10% by weight of the total composition. Preferably, the amount by weight of such dispersant-VI improvers in the composition of this invention is at least equal to the amount of solid particles, e.g., graphite, molybdenum disulfide and the like, present. More preferably, the amount of dispersant-VI improver is at least about 2 times, still more preferably at least about 3 times, the amount of solid particles.

The compositions of the present invention possess the advantageous combination of a high degree of effectiveness with respect to lubricity, dispersant-detergent properties, pour-point depressing action and viscosity index improvements. Further, the present compositions provide for improved fuel economy and reduced tendency to form deposits.

In addition to the advantages already described herein, lubricating compositions contemplated herein may contain other conventional agents, such as, for example, antioxidants, metal deactivators, pour point depressants, oiliness agents, blooming agents, peptizing agents, and the like.

The lubricating compositions of the present invention may be prepared in any conventional manner. For example, the various components may be brought together and blended at a slightly elevated temperature, i.e., about 100° to 130° F., to insure a uniform composition.

In many instances, the additives incorporated into the present lubricating compositions are available as a mixture in a mineral oil or other solvent carrier. Unless otherwise noted, the weight proportions given above refer to the amount of additive material on a carrier or solvent free basis.

The lubricating compositions of the present invention can be used to lubricate internal combustion engines. Maintaining (or causing to be maintained) a lubricating amount of the lubrication compositions of the present invention on the components of such internal combustion engine requiring lubrication, results in obtaining substantial benefits from the present invention.

The following examples illustrate clearly the present invention. However, these examples are not to be interpreted as specific limitations on the invention.

EXAMPLES 1 TO 3

The following examples illustrate certain of the outstanding benefits of the present invention.

A series of three lubricating oil compositions were prepared by blending together individual components, noted below, at a slightly elevated temperature, i.e., about 100° F. to about 130° F., to insure proper mixing. The final compositions were as follows:

| | EXAMPLES | | |
|---|---|---|---|
| Component, Wt. % | 1 | 2 | 3 |
| Mineral Oil, 125 SUS at 100° F. | 84.0 | 74.7 | 74.6 |
| Conventional Additive Mixture(1) | 7.4 | 7.5 | 7.6 |
| Methacrylate Polymer(2) | 8.6 | 7.8 | — |
| Methacrylate-N—Vinyl Pyrrolidone Copolymer(3) | — | — | 7.8 |
| Graphite Dispersion(4) | — | 10.0 | 10.0 |

(1)This mixture is a commercially available combination of materials each of which is conventionally used in lubricating oil compositions. This mixture includes alkyl zinc dithiophosphate, both overbased and neutral calcium sulfonates, calcium phosphonatephenate and both an ashless dispersant and an ashless rust inhibitor. This mixture also included about 50% by weight of a light mineral oil as solvent for the active ingredients.

(2)A commercially available methacrylate polymer known and conventionally used to improve the viscosity index of lubricating oil polymers. Such polymer includes essentially no N—vinyl pyrrolidone. The material as used includes about 50% by weight of a mineral oil as solvent for the polymer. The polymer is believed to have an average molecular weight of about 800,000 and to be derived from a methacrylic ester containing about 16 carbon atoms per molecule.

(3)A mixture of methacrylate ester-N—vinyl pyrrolidone copolymer in about 50% by weight (based on the total mixture) of a mineral oil solvent. This mixture contains about 0.18% by weight of nitrogen. The copolymer is believed to be derived from a methacrylic ester containing about 16 carbon atoms per molecule and is prepared using conventional techniques. The copolymer is believed to have an average molecular weight of about 800,000 and a mole ratio of N—vinyl pyrrolidone to methacrylate ester of about 1 to 10.

(4)A mineral oil-based dispersion containing about 10% by weight of solid graphite particles which have an average (by weight) particle size of about 200 millimicrons. The dispersion also includes about 6% of a nitrogen and methacrylate-containing dispersant to aid in maintaining dispersion stability. This dispersant is believed to be derived from a methacrylic ester containing about 16 carbon atoms per molecule.

Each of these lubricating oil compositions was used to lubricate an internal combustion engine which, in turn, was operated through a Reference Sequence V C Test. This test, in which the engine is operated for 192 hours, is described in "Multicylinder Test Sequences for Evaluating Automotive Engine Oils—ASTM Special Technical Publication 315F", American Society for Testing and Materials (1973). This procedure is known to produce data which can be used to make valid comparisons of the effects various lubricating oil compositions have on engine sludge and varnish ratings under normal operating conditions.

Sludge and varnish ratings in the Reference Sequence V C Test are based upon visual inspection of various engine components and comparison with a series of CRC reference standards.

Results of this test using each of the above-described lubricating compositions are summarized below. For comparison purposes, minimum SE standard lubricating oil qualification ratings are also presented.

| REFERENCE SEQUENCE VC RESULTS | COMPOSITION 1 | 2 | 3 | SE MINIMUM RATINGS |
|---|---|---|---|---|
| Average Overall Sludge Rating | 8.7 | 8.1 | 9.0 | 8.5 |
| Average Overall | 8.3 | 7.8 | 8.5 | 8.0 |

-continued

| REFERENCE SEQUENCE VC RESULTS | COMPOSITION 1 | 2 | 3 | SE MINIMUM RATINGS |
|---|---|---|---|---|
| Varnish Rating | | | | |
| Piston Skirt Varnish Rating | 8.3 | 8.0 | 8.6 | 7.9 |

The above data indicate that the present compositions which include both solid particles and a co-polymer of a acrylic ester and an N-vinyl pyrrolidone provide substantially and surprisingly improved sludge and varnish ratings, for example, ratings which exceed the minimum standards required for qualification. These results are particularly surprising in view of the substantial decrease in sludge and varnish ratings (increased in sludge and varnish formation) caused by the inclusion of graphite solid particles, as is apparent from the results with Composition 2. Thus, the inclusion of a conventional viscosity index improver, which provides adequate sludge and varnish formation protection (see Example 1) when included in a composition without solid particles, fails to meet the SE qualification standards when such solid particles are added. However, SE standards are more than adequately met by the inclusion of the presently useful copolymers in graphite-containing lubricating oil compositions.

EXAMPLE 4–7

The following examples illustrate certain of the outstanding benefits of the present invention wherein the dispersant-VI improver is an oxidized functional polymer.

A series of four lubricating oil compositions were prepared by blending together individual components, noted below, at a slightly elevated temperature, i.e., about 100° F. to about 130° F., to insure proper mixing. The final compositions were as follows:

| Components, Wt. % | Examples 4 | 5 | 6 | 7 |
|---|---|---|---|---|
| Mineral Oil, 125 SUS at 100° F. | 84.0 | 74.7 | 67.5 | 67.5 |
| Conventional Additive Mixture(1) | 7.4 | 7.5 | 7.5 | 7.5 |
| Methacrylate Polymer(2) | 8.6 | 7.8 | — | — |
| Functional Polymer(3) | — | — | 15.0 | — |
| Functional Polymer(4) | — | — | — | 15.0 |
| Graphite Dispersion(5) | — | 10.0 | 10.0 | 10.0 |

(1)This mixture is a commercially available combination of materials each of which is conventionally used in lubricating oil compositions. This mixture includes alkyl zinc dithiophosphate, both overbased and neutral calcium sulfonates, calcium phosphonate-phenate and both an ashless dispersant and an ashless rust inhibitor. This mixture also included about 50% by weight of a light mineral oil as solvent for the active ingredients.

(2)A commercially available methacrylate polymer known and conventionally used to improve the viscosity index of lubricating oil polymers. Such polymer includes essentially no N—vinyl pyrrolidone. The material as used includes about 50% by weight of a mineral oil as solvent for the polymer. The polymer is believed to have an average molecular weight of about 800,000 and to be derived from a methacrylic ester containing about 16 carbon atoms per molecule.

(3)A functional polymer of the invention comprising the reaction product of the following reaction. Five hundred grams of an ethylenepropylene copolymer, having a number average molecular weight of 1,800–2,000, are placed in an open reaction vessel and heated at 310° F. for 3 hours while being vigorously stirred. At the end of 3 hours the oxidation is complete. The oxygen content of the product was 3.7 percent.

0.285 mole of the oxidized co-polymer, is heated at 300° F., under 1.0 CFH nitrogen, while 49 grams (0.258 mole) tetraethylene pentamine (TEPA) is added over a 10 minute period. Heating and moderately rapid stirring is continued for 1 hour, during which time water formed as a by-product is swept from the reaction zone with nitrogen bleed. The recovered product contains 1.25 percent nitrogen (theoretical 1.25 percent).

(4)A functional polymer of the invention comprising the reaction product of the following reactions. An amorphous ethylene-propylene co-polymer is prepared by solution polymerization using a Ziegler-Natta type catalyst, vanadium oxytrichloride solution in combination with an ethylaluminum sesquichloride solution. Dry n-heptane (1200 ml.) is saturated at 86° F. and 30 p.s.i.g. with a gas mixture consisting of 50 mole percent ethylene, 35 mole percent propylene and 15 mole percent hydrogen. The gas mixture is introduced at the rate of 100 liters per hour, circulated through the heptane, and then passed out of the system.

When saturation is complete, the addition of the catalyst components, in heptane solution is started. The vanadium oxytrichloride solution (0.370 percent by weight) is introduced into the olefin mixture at the rate of 13 ml/hr., and the ethylaluminum sesquichloride solution (0.459 percent-wt.) at the rate of 60 ml/hr; the molar ratio of Al/V is 8.06. When polymerization begins the inflow of the propylene and of the ethylene is adjusted to compensate for the greater reactivity of the latter. The average ratio of propylene-/ethylene by weight is 2.3. After 1.25 hours polymerization is stopped by displacing the gas mixture with nitrogen and stopping the catalyst addition. The reaction mixture is then washed twice with methanol to deactivate and remove the catalyst.

The recovered co-polymer has a number average molecular weight ($M_n$) of 28,000 (determined by vapor pressure osmometry); 159 pendant methyl groups per 1000 chain carbon atoms (determined by infrared spectoscopy), and an inherent viscosity of 2.28 dl/g. (measured in decalin at 135° C. and 0.1 g./100 ml.).

A solution of 70 grams of the co-polymer, in 1000 grams of heptane heated to 250° F., while blowing, with nitrogen, to remove the heptane, and 280 grams of a SAE 5W mineral oil is gradually added as the heptane is removed, and the viscous oil copolymer mixture brought to 430° F. with vigorous stirring. Blowing with nitrogen is discontinued at this point, to allow atmospheric oxygen to diffuse into the reaction vessel. After 0.5 hour, thermal and oxidative degradations reduced the viscosity of the mixture such that vigorous stirring could be maintained at the optimum oxidation temperature of 310° F.

Heating with stirring is continued at such temperature for a total of 2.5 hours. The resulting product is an oil solution of oxidized co-polymer. 66.5 grams of the oil solution of the oxidized co-polymer (20.0 percent active oxidized co-polymer) is added to 900 grams of benzene, and the solution heated to 120° F. Solid paraformaldehyde (0.69 grams, 0.52 percent by weight on oxidized co-polymer) is then added and the mixture heated to a temperature of 140° F. over a 0.5 hour period. Hexamethylene diamine (2.66 grams; 2.0 percent by weight on the oxidized co-polymer) is then added and the solution is refluxed vigorously for three hours at 176° F. The resultant functional polymer product is then heated at 300° F., with nitrogen blowing, for one hour to remove the benzene solvent.

(5)A mineral oil-based dispersion containing about 10% by weight of solid graphite particles which have an average (by weight) particle size of about 200 millimicrons. The dispersion also includes about 6% of a nitrogen and methacrylate-containing dispersant to aid in maintaining dispersion stability. This dispersant is believed to be derived from a methacrylic ester containing about 16 carbon atoms per molecule.

Each of these lubricating oil compositions identified in Examples 4 and 5 was used to lubricate an internal combustion engine which, in turn, was operated through a Reference Sequence V C Test. This test, in which the engine is operated for 192 hours, is described in "Multicylinder Test Sequences for Evaluating Automotive Engine Oils—ASTM Special Technical Publication (1973). This procedure is known to produce data which can be used to make valid comparisons of the effects various lubricating oil compositions have on engine sludge and varnish ratings under normal operating conditions.

Sludge and varnish ratings in the Reference Sequence V C Test are based upon visual inspection of various engine components and comparison with a series of CRC reference standards.

Results of this test using each of the above-described lubricating compositions are summarized below. For comparison purposes, mininum SE standard lubricating oil qualification ratings are also presented.

| REFERENCE SEQUENCE VC RESULTS | COMPOSITION 4 | COMPOSITION 5 | SE MINIMUM RATINGS |
|---|---|---|---|
| Average Overall Sludge Rating | 8.7 | 8.1 | 8.5 |
| Average Overall Varnish Rating | 8.3 | 7.8 | 8.0 |
| Piston Skirt | 8.3 | 8.0 | 7.9 |

The above data indicate that compositions which include solid particles cause a substantial decrease in sludge and varnish ratings (increase in sludge and varnish formation). This conclusion is apparent by comparing the results from Composition 5 with those from the non-graphite containing Composition 4. Thus, the inclusion of the conventional viscosity index improver, which provides adequate sludge and varnish formation protection (see Example 4) when included in a composition without solid particles, fails to meet the SE qualification standards when such solid particles are added.

The sequence V C Test described in Examples 4 and 5 illustrate the problems in formulating a suitable solids particles-containing lubricating composition. Examples 6 and 7 are lubricating compositions in accordance with the invention. These lubricating compositions containing graphite and certain defined functional polymers provide reduced sludge and varnish deposition relative to lubricating compositions not containing these polymers, and are illustrative of the improved solids-containing lubricating compositions of the invention.

EXAMPLES 8-11

The following examples illustrate certain of the outstanding benefits of the present invention wherein the dispersant-VI improver is a nitrogen-containing polymer.

A series of four lubricating oil compositions were prepared by blending together individual components, noted below, at a slightly elevated temperature, i.e., about 100° F. to about 130° F., to insure proper mixing. The final compositions were as follows:

| Component, Wt. % | 8 | 9 | 10 | 11 |
|---|---|---|---|---|
| Mineral Oil, 125 SUS at 100° F. | 84.0 | 74.7 | 75.0 | 75.0 |
| Conventional Additive Mixture(1) | 7.4 | 7.5 | 7.5 | 7.5 |
| Methacrylate Polymer(2) | 8.6 | 7.8 | | |
| Nitrogen-containing graft polymer(3) | — | — | 7.5 | — |
| Nitrogen-containing interpolymer(4) | — | — | — | 7.5 |
| Graphite Dispersion(5) | — | 10.0 | 10.0 | 10.0 |

(1)This mixture is a commercially available combination of materials each of which is conventionally used in lubricating oil compositions. This mixture includes alkyl zinc dithiophosphate, both overbased and neutral calcium sulfonates, calcium phosphonate-phenate and both an ashless dispersant and an ashless rust inhibitor. This mixture also included about 50% by weight of a light mineral oil as solvent for the active ingredients.

(2)A commercially available methacrylate polymer known and conventionally used to improve the viscosity index of lubricating oil polymers. Such polymer includes essentially no N—vinyl pyrrolidone. The material as used includes about 50% by weight of a mineral oil as solvent for the polymer. The polymer is believed to have an average molecular weight of about 800,000 and to be derived from a methacrylic ester containing about 16 carbon atoms per molecule.

(3)A graft polymer prepared in accordance with U.S. Pat. No. 3,923,930 having a terpolymer backbone of ethylene, propylene and 4,4-hexadiene present in a weight ratio of about 50:46:4. This terpolymer has an intrinsic viscosity of about 1.1, about one mole of unsaturation per 2000 grams of terpolymer and about 1500 carbon atoms per terpolymer molecule. N,N—Dimethyaminoethyl methacrylate is grafted on the terpolymer backbone. About 2.67 grams of the methacrylate is employed. The graft polymer contains about 0.04 weight percent of nitrogen.

(4)A series of nitrogen-containing interpolymers having a molecular weight between 30,000 and 120,000 prepared by reacting a mixture of $C_{12}$-$C_{16}$ alkylmethacrylates (Neodol 25L) and $C_{16}$-$C_{20}$ alkylmethacrylates (Alfor 1620 SP) with either dimethylaminoethyl methacrylate or N(1,1 dimethylbutan-3-one) acrylamide in the following proportions:

| Monomers, wt. % | | | | | | | | |
|---|---|---|---|---|---|---|---|---|
| Dimethylaminoethylmethacrylate | 4 | — | — | 5 | — | 8 | 10 | — |
| N(1,1 dimethylbutan-3-one) acrylamide | — | 4 | 5 | — | 8 | — | — | 10 |
| $C_{12}$-$C_{16}$ alkylmethacrylate (Neodol 25L) | 71 | 71 | 70 | 70 | 67 | 67 | 70 | 70 |
| $C_{16}$-$C_{20}$ alkylmethacrylate (Alfor 1620SP) | 25 | 25 | 25 | 25 | 25 | 25 | 20 | 20 |

The monomers are combined with 100 grams of a hydrofined paraffin base oil having a viscosity of about 145 SUS at 100° F. and are charged to a one liter resin kettle and purged with purified nitrogen for 40 minutes. The reaction mixture is then heated to 80°-83° C. and 0.5 grams of azobisiosbutronitrile and 0.3 grams of dodecyl mercaptan are added and the polymerization allowed to proceed to completion over a period of four hours. The temperature is then raised to 100° C. and held for one hour at this temperature at which point 300 grams of a hydrofined dewaxed paraffin base oil having a viscosity of about 100 SUS at 100° F. are added and the temperature is held at 100° C. for an additional hour. The reactor contents are nitrogen-containing interpolymers dissolved in an oil diluent. The weight amount employed is on a diluent-free basis.

(5)A mineral oil-based dispersion containing about 10% by weight of solid graphite particles which have an average (by weight) particle size of about 200 millimicrons. The dispersion also includes about 6% of a nitrogen and methacrylate-containing dispersant to aid in maintaining dispersion stability. The dispersant is believed to be derived from a methacrylic ester containing about 16 carbon atoms per molecule.

Each of the lubricating oil compositions identified in Examples 8 and 11 was used to lubricate an internal combustion engine which, in turn, was operated through a Reference Sequence V C Test. This test, in which the engine is operated for 192 hours, is described in "Multicylinder Test Sequences for Evaluating Automotive Engine Oils-ASTM Special Technical Publication 315F", American Society for Testing and Materials (1973). This procedure is known to produce data which can be used to make valid comparisons of the effects various lubricating oil compositions have on engine sludge and varnish ratings under normal operating conditions.

Sludge and varnish ratings in the Reference Sequence V C Test are based upon visual inspection of various engine components and comparison with a series of CRC reference standards.

Results of this test using each of the above-described lubricating compositions are summarized below. For comparison purposes, minimun SE standard lubricating oil qualification ratings are also presented.

| REFERENCE SEQUENCE VC RESULTS | COMPOSITION 8 | COMPOSITION 9 | SE MINIMUM RATINGS |
|---|---|---|---|
| Average Overall Sludge Rating | 8.7 | 8.1 | 8.5 |
| Average Overall Varnish Rating | 8.3 | 7.8 | 8.0 |
| Piston Skirt | 8.3 | 8.0 | 7.9 |

The above data indicate that compositions which include solid particles cause a substantial decrease in sludge and varnish ratings (increase in sludge and varnish formation). This conclusion is apparent by comparing the results from Composition 9 with those from the non-graphite containing Composition 8. Thus, the inclusion of the conventional viscosity index improver, which provides adequate sludge and varnish formation protection (see Example 8) when included in a composition without solid particles, fails to meet the SE qualification standards when such solid particles are added.

The Sequence V C Test described in Examples 8 and 9 illustrate the problems in formulating a suitable solids particles-containing lubricating composition. Examples 10 and 11 are lubricating oil composition in accordance with the invention. These lubricating compositions containing graphite and nitrogen-containing polymers of the invention provide reduced sludge and varnish deposition relative to lubricating compositions not containing these nitrogen-containing polymers, and are illustrative of the improved solids containing lubricating compositions of the invention.

EXAMPLES 12–15

The following examples illustrate certain of the outstanding benefits of the present invention wherein a dispersant-VI improver which is a nitrogen-containing mixed ester is employed.

A series of four lubricating oil compositions were prepared by blending together individual components, noted below, at a slightly elevated temperature, i.e., about 100° F. to about 130° F., to insure proper mixing. The final compositions were as follows:

| | Example | | | |
|---|---|---|---|---|
| Component, Wt. % | 12 | 13 | 14 | 15 |
| Mineral Oil, 125 SUS at 100° F. | 84.0 | 74.7 | 74.2 | 74.2 |
| Conventional Additive Mixture(1) | 7.4 | 7.5 | 7.5 | 7.5 |
| Methacrylate Polymer(2) | 8.6 | 7.8 | — | — |
| Nitrogen-containing interpolymer(3) | — | — | 8.3 | — |
| Nitrogen-containing interpolymer(4) | — | — | — | 8.3 |
| Graphite Dispersion(5) | — | 10.0 | 10.0 | 10.0 |

(1)This mixture is a commercially available combination of materials, each of which is conventionally used in lubricating oil compositions. This mixture includes alkyl zinc dithiophosphate, both overbased and neutral calcium sulfonates, calcium phosphonate-phenate and both an ashless dispersant and an ashless rust inhibitor. This mixture also included about 50% by weight of a light mineral oil as solvent for the active ingredients.

(2)A commercially available methacrylate polymer known and conventionally used to improve the viscosity index of lubricating oil polymers. Such polymer includes essentially no N—vinyl pyrrolidone. The material as used includes about 50% by weight of a mineral oil as solvent for the polymer. The polymer is believed to have an average molecular weight of about 800,000 and to be derived from a methacrylic ester containing about 16 carbon atoms per molecule.

(3)A styrene maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42) part in a similar benzene-toluene mixture (2.7 parts).

The resulting product is a thick slurry of the interpolymer in the solvent mixture. A mineral oil (141 parts) is added to the slurry while the solvent mixture is being distilled off at 150° C. and then at 150° C./200 mm. Hg.

To 209 parts of the stripped mineral oil-interpolymer slurry (the interpolymer having a reduced specific viscosity of 0.72) there are added toluene (25.2 parts), n-butyl alcohol (4.8 parts), a commercial alcohol consisting essentially of primary alcohols having from 12 to 18 carbon atoms (55.6 parts) and a commercial alcohol consisting of primary alcohols having from 8 to 10 carbon atoms (10 parts) and to the resulting mixture there is added 96% sulfuric acid (2.3 parts).

The mixture is then heated at 150°–160° C. for 20 hours whereupon water is distilled off. An additional amount of sulfuric acid (0.18 part) together with an additional amount of n-butyl alcohol (3 parts) is added and the esterification is continued until 95% of the carboxy radicals of the polymer has been esterified.

To the esterified interpolymer, there is then added aminopropyl morpholine (3.71 parts; 10% in excess of the stoichiometric amount required to neutralize the remaining free carboxy radicals) and the resulting mixture is heated to 150°–160° C./10 mm. Hg to distill off toluene and any other volatile components.

The stripped product is mixed with an additional amount of mineral oil (12 parts) and filtered. The filtrate is a mineral oil solution of the nitrogen-containing mixed ester having a nitrogen content of 0.16–0.17%.

(4)A carboxy interpolymer is obtained by preparing a solution of styrene (16.3 parts by weight) and maleic anhydride (12.9 parts by weight) in a benzene-toluene solution (270 parts; weight ratio of benzene to toluene being 66.5 to 33.5) and contacting the solution at 86° C. in nitrogen atmosphere for 8 hours with a catalyst solution prepared by dissolving 70% benzoyl peroxide (0.42 part by weight) in similar benzene-toluene mixture (2.7 parts by weight).

The resulting product is a thick slurry of the interpolymer in the solvent mixture. To the slurry there is added mineral oil (141 parts by weight) while the solvent mixture is being distilled off at 150° C. and then at 150° C./200 mm Hg.

To 209 parts by weight of the stripped mineral oil-interpolymer slurry (the interpolymer having a reduced specific viscosity of 0.72) there are added toluene (25.2 parts by weight), n-butyl alcohol (4.8 parts by weight), a commercial alcohol consisting essentially of primary alcohols having from 12 to 18 carbon atoms (56.6 parts by weight) and a commercial alcohol consisting of primary alcohols having from 8 to 10 carbon atoms (10 parts by weight) and to the resulting mixture there is added 96% sulfuric acid (2.3 parts by weight).

The mixture is then heated at 150°–160° C. for 20 hours whereupon water is distilled off. An additional amount of sulfuric acid (0.18 part by weight) together with an additional amount of n-butyl alcohol (3.0 parts by weight) is added and the esterification is continued until 95% of the carboxy radicals of the polymer has been esterified.

To the esterified interpolymer (400 parts by weight), there is then added hydrazine (64% aqueous solution) (2.7 parts by weight) and the resulting mixture is heated to 150° C. and then to 150° C./100 mm Hg. to distill off volatile components.

The stripped product is mixed with mineral oil (126 parts by weight) and filtered. The filtrate is a mineral oil solution of the nitrogen-containing ester.

(5)A mineral oil-based dispersion containing about 10% by weight of solid graphite particles which have an average (by weight) particle size of about 200 millimicrons. The dispersion also includes about 6% of a nitrogen and methacrylate-containing dispersant to aid in maintaining dispersion stability. This dispersant is believed to be derived from a methacrylic ester containing about 16 carbon atoms per molecule.

Each of these lubricating oil compositions identified in Examples 12 and 13 was used to lubricate an internal combustion engine which, in turn, was operated through a Reference Sequence V C Test. This test, in which the engine is operated for 192 hours, is described in "Multicylinder Test Sequences for Evaluating Automotive Engine Oils-ASTM Special Technical Publication 315F", American Society for Testing and Materials (1973). This procedure is known to produce data which can be used to make valid comparisons of the effects various lubricating oil compositions have on engine sludge and varnish ratings under normal operating conditions.

Sludge and varnish ratings in the Reference Sequence V C Test are based upon visual inspection of various engine components and comparison with a series of CRC reference standards.

Results of this test using each of the above-described lubricating compositions are summarized below. For comparison purposes, miminum SE standard lubricating oil qualification ratings are also presented.

| REFERENCE SEQUENCE VC RESULTS | COMPOSITION 1 | COMPOSITION 2 | SE MINIMUM RATINGS |
|---|---|---|---|
| Average Overall Sludge Rating | 8.7 | 8.1 | 8.5 |
| Average Overall Varnish Rating | 8.3 | 7.8 | 8.0 |
| Piston Skirt | 8.3 | 8.0 | 7.9 |

The above data indicate that compositions which include solid particles cause a substantial decrease in sludge and varnish ratings (increase in sludge and varnish formation). This conclusion is apparent by comparing the results from Composition 13 with those from the non-graphite containing Composition 12. Thus, the inclusion of the conventional viscosity index improver, which provides adequate sludge and varnish formation protection (see Example 12) when included in a composition without solid particles, fails to meet the SE qualification standards when such solid particles are added.

The Sequence V C Test described in Examples 12 and 13 illustrate the problems in formulating a suitable solids particles-containing lubricating composition. Examples 14 and 15 are lubricating oil composition in accordance with the invention. These lubricating compositions containing graphite and nitrogen containing esters of carboxy-containing interpolymers of the invention provide reduced sludge and varnish deposition relative to lubricating compositions not containing these interpolymers, and are illustrative of the improved solids containing lubricating compositions of the invention.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A lubricating oil composition of matter comprising: a major amount by weight of oil of lubricating viscosity; from about 0.1% to about 2% by weight of the total composition of solid particles effective to improve the lubricating properties of said composition; and from about 3% to about 10% by weight of the total composition of at least one dispersant-VI improver compound which acts to improve the dispersant properties of said lubricating oil composition and also acts to improve the viscosity index of said lubricating oil composition, said solid particles being selected from the group consisting of graphite, molybdenum disulfide, zinc oxide, and mixtures thereof, said composition of matter characterized by its ability to reduce friction in an internal combustion engine without exhibiting unacceptable deposit forming tendencies.

2. The composition of claim 1 wherein said dispersant-VI improver compound is present in an amount of at least about 2.5 times the amount of said solid particles.

3. The composition of claim 1 wherein said dispersant-VI improver compound is present in an amount of at least about 3 times the amount of said solid particles.

* * * * *